US005975778A

United States Patent [19]

Kanemitsu

[11] Patent Number: 5,975,778

[45] Date of Patent: Nov. 2, 1999

[54] RECORDING APPARATUS HAVING A RECORDING MATERIAL CONFINING MEMBER

[75] Inventor: Shinji Kanemitsu, Yokohama, Japan

[73] Assignee: Canon Kabushiki Kaisha, Tokyo, Japan

[21] Appl. No.: 08/906,106

[22] Filed: Aug. 5, 1997

Related U.S. Application Data

[63] Continuation of application No. 08/806,546, Feb. 24, 1997, abandoned, which is a continuation of application No. 08/529,666, Sep. 18, 1995, abandoned, which is a continuation of application No. 08/074,415, Jun. 10, 1993, abandoned.

[30] Foreign Application Priority Data

Jun. 10, 1992 [JP] Japan ..... 4-176285

[51] Int. Cl.[6] ..... B41J 11/22

[52] U.S. Cl. ..... 400/352; 400/59; 400/48; 400/642; 347/37

[58] Field of Search ..... 400/48, 55, 56, 400/57, 58, 59, 352, 355, 356, 642, 645; 347/37

[56] References Cited

U.S. PATENT DOCUMENTS

| | | | |
|---|---|---|---|
| 4,024,940 | 5/1977 | Hendrischk et al. | 400/352 |
| 4,090,600 | 5/1978 | Biedermann | 400/56 |
| 4,227,219 | 10/1980 | Takemoto | 347/37 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,978,979 | 12/1990 | Asakawa | 400/56 |
| 5,151,716 | 9/1992 | Kanemitsu | 346/140 R |
| 5,177,547 | 1/1993 | Kanemitsu et al. | 359/161 |
| 5,366,305 | 11/1994 | Christianson | 400/352 |
| 5,547,295 | 8/1996 | Kanemitsu | 400/279 |

FOREIGN PATENT DOCUMENTS

| | | | |
|---|---|---|---|
| 54-056847 | 5/1979 | Japan . | |
| 0078776 | 5/1983 | Japan | 400/352 |
| 59-123670 | 7/1984 | Japan . | |
| 59-138461 | 8/1984 | Japan . | |
| 60-071260 | 4/1985 | Japan . | |
| 0034773 | 2/1989 | Japan | 400/352 |
| 0188382 | 7/1989 | Japan | 400/56 |
| 2-78579 | 3/1990 | Japan . | |
| 0128268 | 5/1991 | Japan | 400/56 |

*Primary Examiner*—Christopher A. Bennett
*Attorney, Agent, or Firm*—Fitzpatrick, Cella, Harper & Scinto

[57] ABSTRACT

A recording apparatus for effecting recording by a recording device carried on a carriage movable along a recording material includes a platen for supporting the recording material in a recording region in which the recording device effects the recording on the recording material; a confining member for confining the recording material on the platen; a supporting member mounted on the carriage to support the carriage for movement thereof along the recording material and in contact with the confining member, wherein the supporting member engages to and disengages from an elastically deformable portion of the confining member outside the recording region.

23 Claims, 5 Drawing Sheets

RECORDING APPARATUS HAVING A RECORDING MATERIAL CONFINING MEMBER

This application is a continuation of application Ser. No. 08/806,546, filed Feb. 24, 1997, now abandoned, which is a continuation of application Ser. No. 08/529,666, filed Sep. 18, 1995, now abandoned which is a continuation of application Ser. No. 08/074,415, filed Jun. 10, 1993, now abandoned.

FIELD OF THE INVENTION

The present invention relates to a recording apparatus for recording on a recording material by a recording mechanism moving along the recording material.

DESCRIPTION OF THE RELATED ART

A known recording apparatus having a function of a printer, copying machine, facsimile machine or the like, or a known recording apparatus usable as an output device for a combined electronic machine or a work station including a computer and a word processor, is designed such that an image (including characters or the like) is recorded on a recording material in the form of a sheet of paper or a plastic sheet or the like in accordance with image information (character information). Such recording machines are classified, on the basis of the recording systems, into an ink jet type, a wire dot type, a thermal type, a laser beam type or the like.

In a serial type recording apparatus in which the main scan occurs in a direction crossing with the sheet material feeding direction (sub-scan direction), the recording material is set at a recording position, and thereafter, the recording material is scanned in the main scan direction by recording means carried on a carriage movable along the recording material. After the recording for one line is completed, the sheet is fed through a predetermined distance, and the sheet is stopped there. Then, the recording for the next line (main scan) is carried out. By repeating these operations, the recording is effected over all of the recording material. On the other hand, in a line type recording apparatus in which only the sub-scan is effected during the recording operation, the recording material is set at the predetermined recording position, and the recording is effected simultaneously for the one line, and the recording material is continuously fed to effect the record over all of the recording material.

In the ink jet type recording apparatus, the ink is ejected onto the recording material from a recording means (recording head) in accordance with an image signal. It is advantageous in that the size of the recording means can be reduced, that fine images can be recorded at high speed, that plain paper is usable without special treatment, that the running cost is low, that the noise is small because it is a non-impact type, and that it is easy to effect the color image recording with the use of a number of different color inks. Among them, a full-multiple recording means having a great number of ejection outlets arranged in the direction of the width of the sheet is advantageous because the recording speed can be further increased.

Particularly, an ink jet type recording means (recording head) which ejects the ink using thermal energy can be easily manufactured with high density liquid passages (ejection outlets), since it can be manufactured by etching, evaporation, sputtering or another semiconductor manufacturing process. To manufacture electrothermal transducers, electrodes, liquid passages and top plate, the electrothermal transducers and electrodes are formed as films on a substrate. In addition, a high resolution image can be recorded at a high speed with a simple and compact structure. On the other hand, various materials for the recording material are desired to be used. Recently, in addition to the usual plain paper or resin thin sheet (OHP sheet or the like), thin sheet paper or processed sheet (the sheet having perforations for filing, the sheets with cutting perforations, or non-rectangular sheet), are desired to be used with printers.

In the serial type recording apparatus using the recording head movable along the recording material the recording head is supported on the carriage (movable member) by rotatably supporting the carriage on a guide rail, and a rolling member (contact portion) in the form of rollers mounted on the carriage, or the like, is urged to the recording material, so that the clearance between the recording head and the recording material is maintained constant.

In this case, the recording material is supported on a platen in the recording region including the contact portion. The contact portion including the rolling members such as rollers, may be directly press-contacted to the recording material. They may be urged through a confining member (sheet confining plate or the like). In such a carriage supporting method, the recording head moves up and down in accordance with the thickness of the recording material, and therefore, the clearance between the recording head and the recording surface of the recording material can be maintained constant irrespective of the material of the recording material used.

Generally, in the ink jet recording apparatus, if the clearance between the recording head and the recording material increases, the positions of the ink droplet deposition varies more with the result of the deterioration of the image quality. If the clearance is too small, the image may be disturbed or contaminated by the contact between the recording head and the recording material, since the recording material having absorbed the ink droplet may wave. Therefore, it is desirable that the clearance between the recording head and the recording material is accurately maintained constant by the carriage.

On the other hand, in the structure in which the recording material is directly confined by the rollers or other rolling members, the carriage may swing due to an impact attributable to the step provided by the thickness of the sheet, at the instance when the carriage rides on the recording material. If this occurs, the recording is disturbed. Therefore in the carriage supporting method described above, the recording material is indirectly confined by the rolling members such as rollers through a confining member such as a sheet confining plate.

When the recording material is confined through the confining member, there is a necessity for releasing the confining member when the recording material is jammed or the like. Because it confines the recording material at the position close to the image forming position, the sheet confining member can be provided only in the region outside the recording head recovery means disposed in the non-recording region. For this reason, it is not possible to use a confining member covering the entirety of the carriage movable range. Therefore, existence of a part (contact and non-contact portion) where the contact portion of the carriage (confining and rolling members such as rollers) and the confining members are contacted to each other or separated from each other, is not avoidable. At this portion, the impact occurs at the time of the carriage movement, and recording is disturbed by the carriage movement by the contact portion.

SUMMARY OF THE INVENTION

Accordingly, it is a principal object of the present invention to provide a recording apparatus capable of forming a high quality image.

It is another object of the present invention to provide a recording apparatus in which the impact or shock during carriage movement by the engaging and disengaging portion between the confining member for confining the recording material and the carriage, can be suppressed, so that the disturbance to the image due to the shock can be minimized.

It is a further object of the present invention to provide a recording apparatus wherein even if there is the engagement and disengagement portion between the confining member for confining the recording material and the carriage, that is used, the required space is small with the advantage of reducing the shock during the carriage movement, so that the disturbance to the recording due to the shock can be minimized.

According to an aspect of the present invention, there is provided a recording apparatus for effecting recording by recording means carried on a carriage movable along a recording material. The apparatus comprises a platen for supporting the recording material in a recording region in which the recording means. effects the recording on the recording material; a confining member for confining the recording material on the platen; a supporting member mounted on the carriage to support the carriage for movement thereof along the recording material and in contact with the confining member, wherein the supporting member engages to and disengages from an elastically deformable portion of the confining member outside the recording region.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, embodiments of the present invention will be described.

Figure 1:
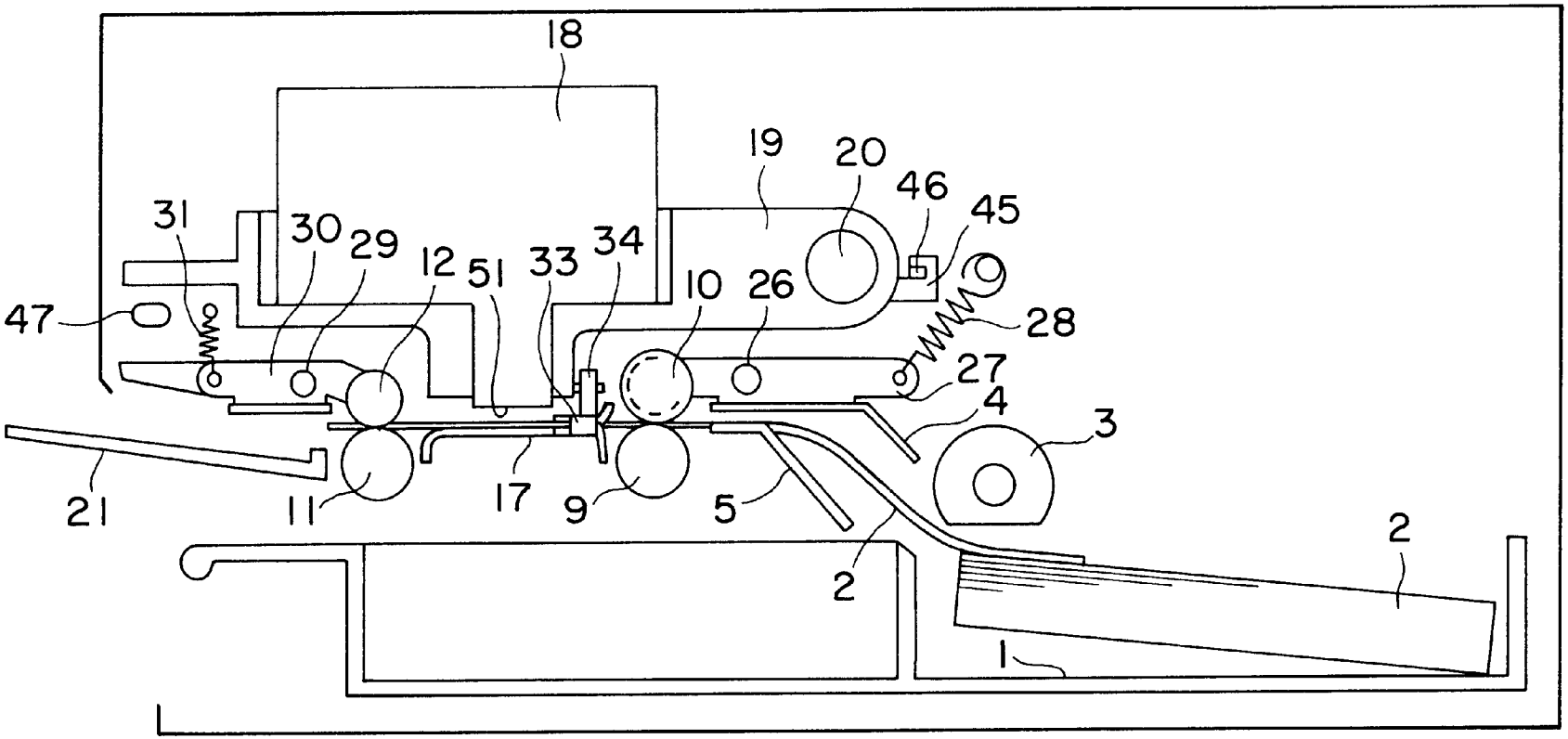
FIG. 1 is a schematic longitudinal sectional view of a recording apparatus according to an embodiment of the present invention.
Figure 2:
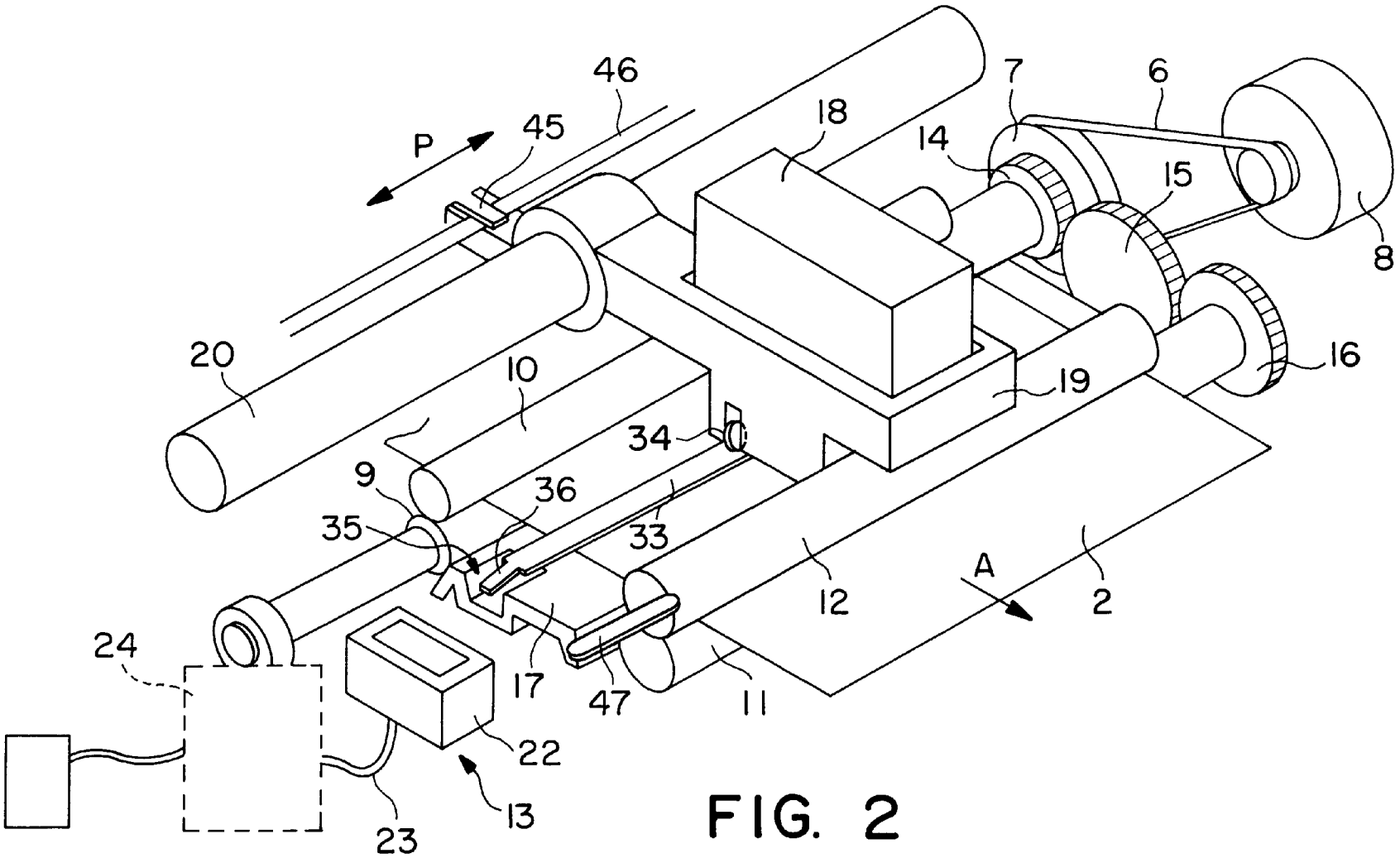
FIG. 2 is a perspective view of a portion of the recording apparatus of FIG. 1.

Referring to FIG. 1, there is shown a recording apparatus according to an embodiment of the present invention. FIG. 2 is a perspective view of a major part of the recording apparatus of FIG. 1. In FIGS. 1 and 2, the sheets of paper or plastic material thin sheets or the like (the recording materials) 2 are contained in a sheet feeding cassette 1, and are fed out one-by-one by rotation of a pick-up roller 3 to between an upper guide 4 and a lower guide 5.

When the pick-up roller 3 rotates through one full turn, it returns to the shown position and stops there. Before that, a lower feeding roller 9 has been started by a pulse motor (recording material feeding motor) 8, so that a leading end portion of the supplied recording material 2 is caught by a nip formed between the lower feeding roller 9 and an upper feeding roller 10 rotated by the lower roller 9. Therefore, the recording material is subsequently fed by the pair of feeding rollers 9 and 10. The feeding rollers 9 and 10 (lower feeding roller 9) are driven by the pulse motor 8 by way of a belt 6 and a pulley 7.

The recording material 2 is further fed by the pair of rollers 9 and 10, and the leading end portion is nipped by discharging rollers 11 and 12. The lower discharging roller 11 is driven by the pulse motor 8 used also to drive the lower roller 9, through gears 14, 15 and 16. Here, a peripheral speed of the lower discharging roller 11 is higher than the peripheral speed of the lower feeding roller 9 by a predetermined amount (2%. for example), by which the recording material 2 is stretched with a predetermined tension to provide a recording surface (the portion supported on the platen 17).

The upper feeding roller 10 is rotatably supported on a pressing plate 27 about a shaft 26, and is press-contacted to the lower feeding roller 9 by a spring 28, so that it is rotated by the lower feeding roller 9. When it is detected by an unshown sensor that the recording material 2 is fed, the lower feeding roller 9 is started to rotate, by which the recording material 2 is intermittently fed at predetermined timing during the recording operation. In FIG. 2, an arrow A indicates the recording material feeding direction (sheet feeding direction).

The lower sheet discharging roller 11 and the upper sheet discharging roller 12, are disposed downstream of the platen 17 to nip the recording material 2 fed onto the platen 17. The upper sheet discharging roller 12 is rotatably supported on a pressing plate 30 about a shaft 29, and is press-contacted to the lower sheet discharging roller 11 by a spring 31, so that it is rotated by the rotation of the lower sheet discharging roller 11. The lower sheet discharging roller 11, as described hereinbefore, rotates in synchronism with the lower feeding roller 9, and the peripheral speed thereof is higher by a few percent than the peripheral speed of the feeding roller 9, by which the recording material 2 on the platen 17 is given a proper tension, so that the recording material is not slack. Above the platen 17, there is a carriage 19 which is reciprocable along a guide rail 20 extending in a direction crossing with a direction along which the recording material 2 is fed. A driving belt 46 for reciprocating the carriage 19 in a direction P is fixed to the carriage at a belt fixing portion 45. In the recording region, the carriage 19 moves in the direction P while it is supported by the guide rail 20 and a roller 34 which will be detailed hereinafter. When the carriage 19 is in the non-recording region which is the region of a taper 36 of a confining member 33 which will be described hereinafter and the region outside thereof, the carriage 19 is supported by the guide rail 20 and a carriage supporting member 47. The carriage supporting member 47 functions to support the carriage at a position slightly lower than the height of the carriage in the recording region.

The carriage 19 carries a recording head 18 (recording mechanism). The recording material feeding through a predetermined amount (sub scan) and one line recording (main scan recording) of the recording head 18 are alternately repeated to effect the recording over the entire range of the recording material 2. The recording material 2 on which the recording is completed, is discharged to the discharge tray 21 by the pair of sheet discharging rollers 11 and 12. In this manner, a series of recording operations is accomplished.

The recording head 18 is an ink jet recording means for ejecting the ink using thermal energy, and is provided with electrothermal transducers for producing thermal energy. The recording head 18 ejects the ink using a pressure change caused by expansion and collapse of a bubble due to film boiling of the ink caused by the thermal energy applied by the electrothermal transducer. By the ejected ink, the recording is effected.

Figure 3:
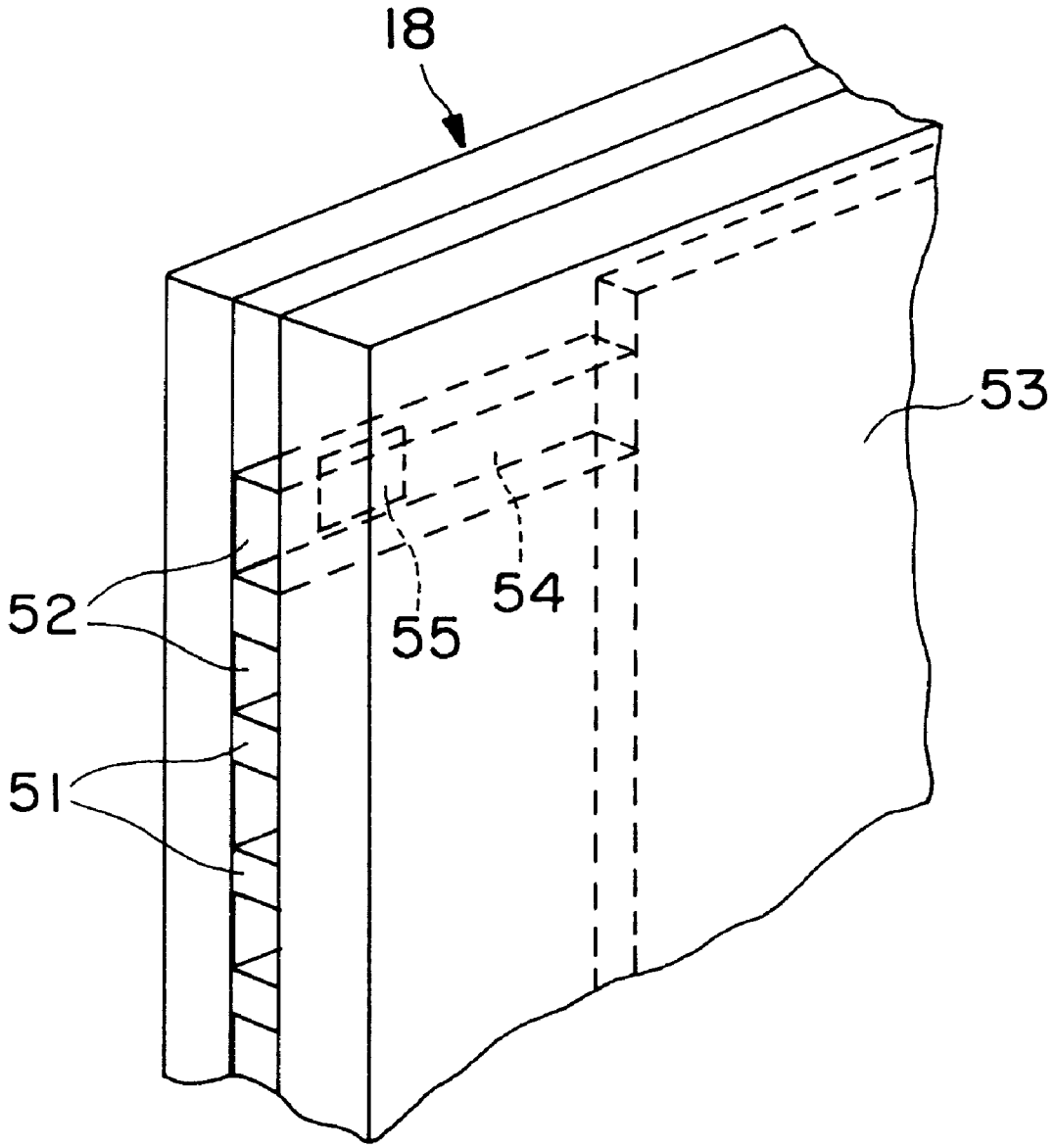
FIG. 3 is a partial perspective view of the ink ejection outlet of the recording mechanism.

FIG. 3 is a perspective view of an ink ejection outlet of the recording head 18. The surface having the ejection outlet 51 is faced to the recording material 2 with a predetermined clearance (approx. 0.5–2.0 mm. for example) therebetween. The surface 51 is provided with a plurality of ejection outlets 52 arranged at a predetermined pitch. On a wall of each of liquid passages 54 for communicating a common liquid chamber 53 and the respective ejection outlets 52, an electrothermal transducer (heat generating resistor, for example) 55 for producing the ink ejection energy is mounted. The recording head 18 is carried on the carriage 19 so that the ejection outlets 52 are arranged in a direction crossing with the movement direction (main scan direction) of the carriage 19. The electrothermal transducers 55 are driven or energized in accordance with image signal or ejection Signal, by which the ink in the passage 54 is film-boiled, and the ink is ejected through the ejection outlet 52 by the pressure produced thereby in the recording mechanism (recording head) 18.

If an ejection outlet 52 of the recording head 18 is clogged during the series of recording operations, the ink is not ejected through the ejection outlet 52, so that the proper recording operation may not be effected. Such a situation can be recovered by a recovery mechanism. In the recording apparatus of FIGS. 1 and 2, a sucking recovery mechanism 13 is disposed at a predetermined position outside the recording region. The sucking recovery mechanism 13 functions to seal the ejection outlet 52 of the recording head 18 by a cap 22, and a vacuum is produced in the cap 22 through a tube 23 by a sucking pump 24, so as to suck out through the ejection outlet 52 foreign matter (solidified ink, bubble, dust or the like) together with the ink.

Referring back to FIGS. 1 and 2, the carriage 19 is rotatably guided and supported about the guide rail 20 which is mounted on a frame of the apparatus. On the other hand, above the platen 17 for supporting the recording material 2, there is provided a confining member (sheet confining plate) 33 to confine the recording material 2 on the platen 17. The carriage 19 is provided with rollers 34 capable of rolling on the confining member 33. The rollers 34 are provided at two positions along the movement direction of the carriage 19. The confining member 33 and the rollers 34 may be provided at both sides of the ejection side surface 51 with respect to the feeding direction of the recording material.

The rollers 34, during rolling motion on the confining member 33, function to form a press-contact portion effective to urge the confining member 33 and therefore the recording material 2 to the platen 17, and also function to support the carriage 19 with a constant clearance between the recording head 18 and the recording material 2. Adjacent an end of the confining member 33, more particularly, adjacent to the end near the recovery mechanism 13 in the shown embodiment, there is an engagement and disengagement part where the roller 34 engages with and disengages from the confining member 33.

Figure 4:
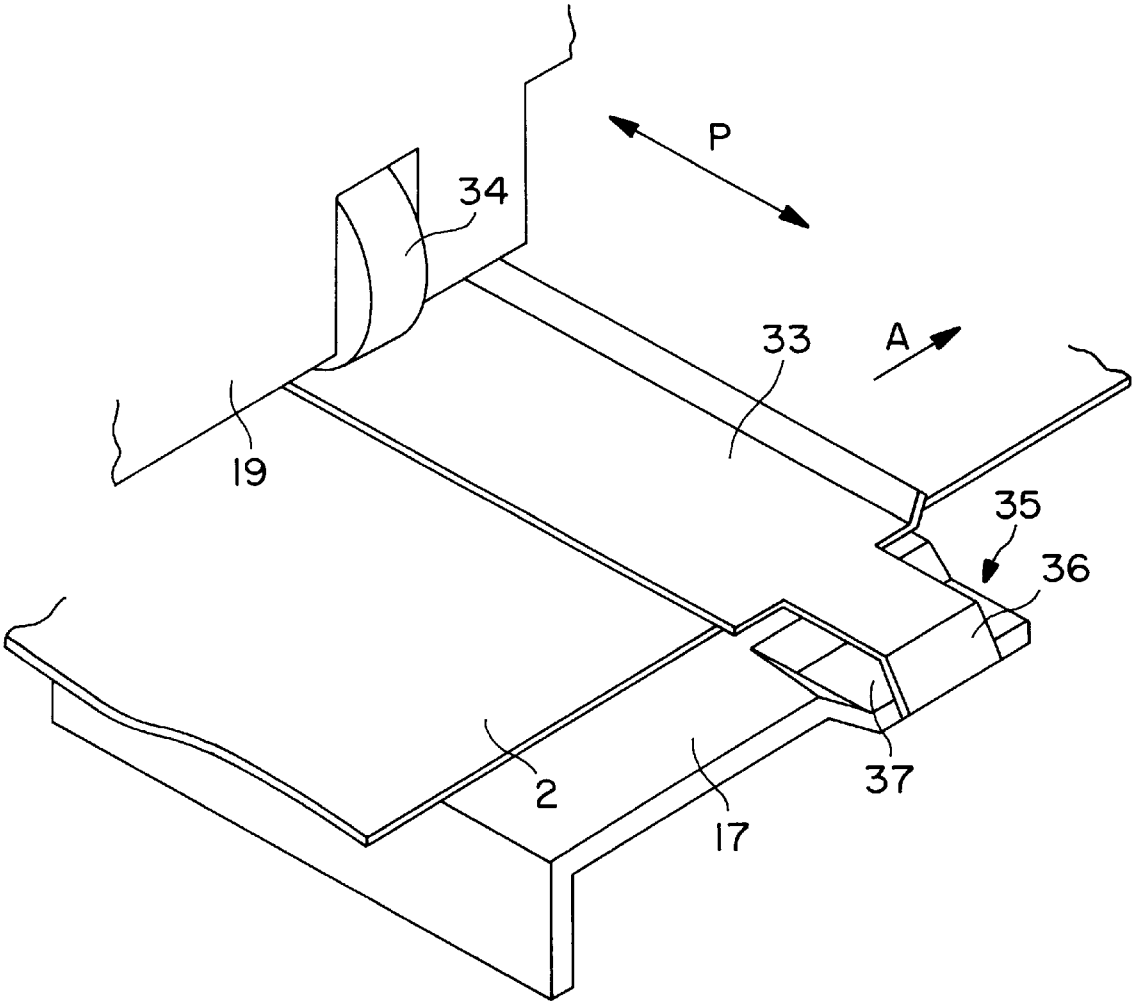
FIG. 4 is a partial perspective view of a major part of the recording apparatus according to an embodiment of the present invention.
Figure 5:
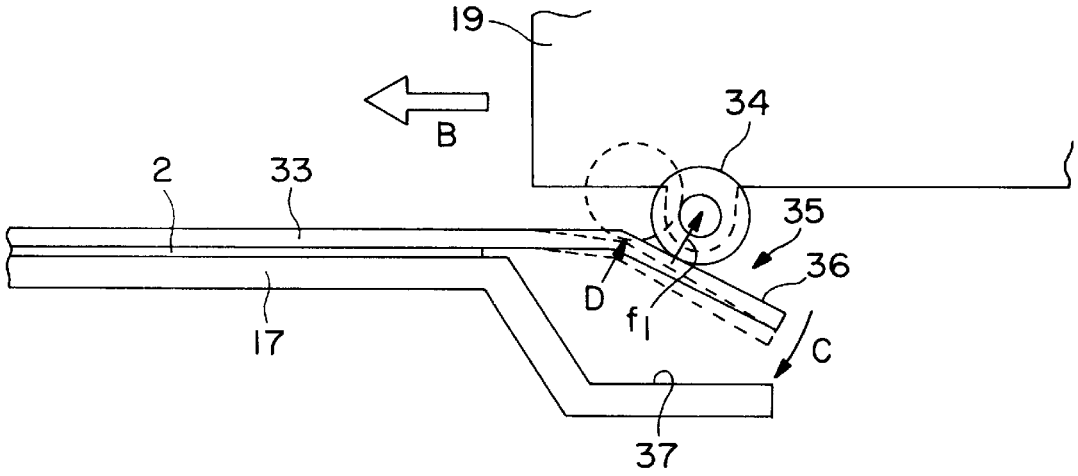
FIG. 5 is a side view of a part of the structure of FIG. 4 when the carriage and the confining member are going to be contacted to each other.

Referring to FIG. 4, there is shown the engaging and disengaging portion 35 in a partial perspective view. FIG. 5 is a side view in which the roller is in contact with the confining member 33 in the engaging and disengaging portion 35. In FIGS. 2, 4 and 5, a tapered surface 36 is formed at an end of the confining member 33, the tapered surface 36 functioning to guide the rollers 34. In a part of the platen 17 which corresponds to the engaging and disengaging portion 35, an escape 37 is formed to accommodate the elastic deformation of the tapered (guide) surface 36 of the confining member 33. The escape 37 is formed by drawing the sheet confining plate 33 up to the part corresponding to an end of the recording material 2.

In FIG. 5, when the carriage 19 moves from the right position (the position of the recovery mechanism 13, for example) to the left (B direction), the roller 34 is brought into contact with the tapered portion 36, and thereafter, the tapered portion 36 starts to elastically deform in the direction C (downward). At this time, as long as a reaction force $f_1$ acting on the roller 34 is smaller than the weight of the carriage 19, the carriage 19 moves in the direction B while maintaining the height shown in FIG. 5, with the carriage 19 being supported by the guide rail 20 and the carriage supporting member 47. By the increase of the elastic deformation of the tapered portion 36 due to the motion of the carriage in the direction B, the reaction force $f_1$ increases, and the carriage 19 is gradually raised from a point D where the reaction force is balanced with the weight of the carriage 19. By the gradual rising of the carriage 19, the impact or shock at the time of the contact can be significantly reduced.

When the carriage 19 moves in the direction which is opposite from the direction B, the opposite actions occur. More particularly, the reaction force $f_1$ acting on the roller 34 gradually decreases while the carriage 19 is being moved away from the confining member 33, and therefore, the shock at the time of the carriage 19 disengagement can be significantly reduced. In the above-described structure, the material of the confining member 33 may be that for a spring (stainless steel for spring, for example) in consideration of the fact that the bending is repeated.

According to this embodiment, there is provided an apparatus comprising a supporting member (platen) 17 for supporting the recording material 2 at the recording position, a confining member 33 for confining the recording material 2 on the supporting member 17, a reciprocable carriage 19 for carrying a recording head 18, a contact portion 34 on the carriage 19 for urging the confining member 33 to the supporting member 17, and an escape 37 for accommodating the elastic deformation of the confining member 33 at a position corresponding to a portion (tapered surface) 36 where the contact portion 34 engages with and disengages from the confining member 33. Therefore, the resiliency of the confining member 33 is used in the engagement and disengagement between the contact portion 34 and the confining member 33, by which the shock during the reciprocal movement of the carriage 19 can be minimized. Accordingly, the disturbance to the recording attributable to the vibration of the recording head 18 caused by the shock or impact can be reduced. In addition, the engaging and disengaging portion 35 of the contact portion 34 and the confining member 33 can be accommodated in the same space as before, and therefore, the size of the recording apparatus is not increased.

Figure 6:
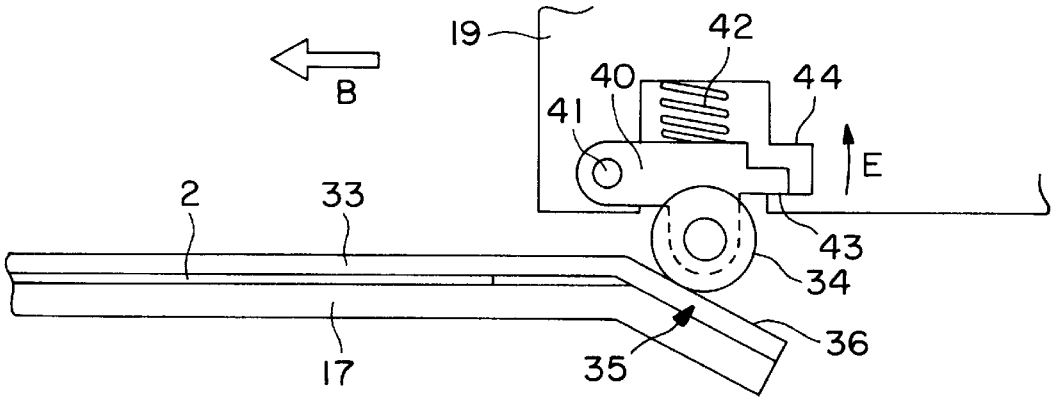
FIG. 6 is a side view of a recording apparatus according to another embodiment of the present invention when the carriage and the confining member are going to be contacted.

Referring to FIG. 6, there is shown a recording apparatus according to another embodiment of the present invention. In this embodiment, as a method for the resilient engagement and disengagement between the confining member (sheet confining plate) 33 and a contacting portion (rollers) 34, the contact portion 34 is urged to the sheet confining member 33 by an elastic or resilient means (spring). More particularly, in FIG. 6, the roller (contact portion) 34 engageable with and disengageable from the confining member 33 is rotatably supported on a holder 40, and the holder 40 is mounted for swinging movement about a shaft 41 mounted on the carriage 19 The holder 40 is urged toward the confining member 33 by a spring (resilient means ) 42 mounted between the carriage 19.

The carriage 19 is provided with an abutment surface (stopper) 43 for limiting the projection position (bottommost position) of the holder 40 and an abutment surface (stopper) 44 for limiting a retracted position (topmost position) of the holder 40. At an end portion (region of the engaging and disengaging portion 35) of the confining member (sheet confining plate) 33, a tapered surface 36 is formed. In this embodiment, there is no need of the provision of the escape 37 at the end of the platen 17, as contrasted to the FIG. 5 embodiment. When the roller 34 is not in contact with the confining member 33, the holder 40 is abutted to the lower abutment surface 43 by the spring 42.

When the carriage 19 moves from the right (the position of the recovery mechanism 13, for example) to the left (direction B), the roller 34 is brought into contact with the tapered portion 36, and then the roller 34 starts to go up the tapered surface 36 with the elastic deformation (compression) of the spring 42. Here, the maximum spring force of the spring 34, that is, the spring force when the holder 40 abuts the upper contact surface 44, is set to be smaller than the weight of the carriage 19. Therefore, together with the movement of the carriage 19 in the direction B, the holder 40 swings in the direction E (upward) to abut the upper abutment surface 44. Thereafter, the carriage 19 is raised along the tapered surface 36.

The other parts of this embodiment are substantially the same as in the foregoing embodiment as has been described in conjunction with FIGS. 1–5, and the detailed description thereof is omitted for the sake of simplicity by assigning the same reference numerals to the elements having the corresponding functions. According to the FIG. 6 embodiment, the roller 34 constituting the contact portion is resiliently supported by the spring 42, and therefore, the roller 34 is prevented from receiving a large load at the instance when the roller 34 is contacted to the confining member 33. Therefore, similarly to the foregoing embodiment, the shock at the time of the carriage movement 19 can be significantly reduced. When the carriage 19 moves in the direction opposite from the direction B, the opposite operation takes place, and the elastic force (resilient urging force) on the roller 34 is gradually decreased, and thereafter, the carriage 19 is disengaged from the confining member 33, and therefore the shock at the time of the disengagement is significantly reduced.

As will be understood from the foregoing, according to the embodiment of FIG. 6, similarly to the foregoing embodiment, the shock at the time of the carriage 19 reciprocation can be significantly reduced, and therefore, the disturbance to the recording attributable to the vibration of the recording head 18 due to the shock can be prevented. Additionally, the engaging and disengaging portion 35 between the contact portion 34 and the confining member 33, can be accommodated in the same space as in the conventional apparatus, and therefore, the size increase of the apparatus can be avoided.

If the structure of FIG. 6 in which the roller 34 is supported by the elastic member 42 is incorporated in the elastically deformable taper portion 36 of FIG. 5, it is possible to further reduce the shock at the time of engagement and disengagement between the carriage 19 and the confining member 33.

In the foregoing embodiment, an ink jet recording apparatus has been taken. However, the present invention is applicable to another ink jet type, wire dot type, thermal type, laser beam type or another recording apparatus for an output device for a computer, word processor or another combined type electronic machine, work station or the like, including a printer, copying machine, facsimile machine and the like.

When the recording apparatus is of an ink jet recording type, the present invention is applicable where the recording means (recording head) is a cartridge type having an integral ink container, where they are separate and are connected with each other by an ink supply tube and where another system is used. In the embodiments, a single recording head 18 is used in the recording apparatus. However, the present invention is applicable to a color recording apparatus using a plurality of recording heads for effecting the recording with different colors and a recording apparatus using a plurality of recording heads capable of effecting different density recordings with the same color. That is, the present invention is applicable irrespective of the number of recording heads or number of colors used.

An ink jet recording apparatus to which the present invention is applicable may comprise a recording head using electromechanical converters such as piezoelectric elements However, an ink jet recording apparatus ejecting the ink using thermal energy is most applicable. In this case, a high density and fine image can be produced.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width,if the recording head moves between its non-recording region and its recording region. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below room temperature but liquefied at room temperature. Since the ink is controlled within the temperature not lower than 30° C. and not higher than 70° C. to stabilize the viscosity of the ink to ensure stable ejection in usual recording apparatus of this type, the ink may be such that it is liquid within the temperature range when the recording signal is present. The present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal produces thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus for effecting recording comprising:

a recording head movable along a recording material;

a platen for supporting the recording material in a recording region where the recording head effects the recording on the recording material;

a confining member for urging the recording material supported on said platen, said confining member being extended along a movable range of the recording head, covering the recording region and a region outside the recording region;

a carriage for moving the recording head in the recording region and the region outside the recording region, wherein said confining member comprises an elastically deformable tapered portion which is inclined away from said carriage toward an end of said confining member, wherein said carriage rides on said confining member from said tapered portion of said confining member, and is in movable contact with said confining member, and wherein said platen comprises an escape for said confining member adjacent to said tapered portion to permit elastic deformation of said confining member.

2. An apparatus according to claim 1, wherein said escape is provided with a stepped shape retracted from a surface of the platen supporting the recording material.

3. An apparatus according to claim 1, wherein said carriage is provided with a rotatable member which is rotatable along a movement direction of said carriage and which rolls on said confining member to permit movement of said carriage.

4. An apparatus according to claim 1, wherein the recording head is an ink jet recording head for ejecting ink through an ejection opening onto the recording material to effect recording.

5. An apparatus according to claim 1, wherein the recording head is provided with an electrothermal transducer for producing thermal energy for ejecting the ink through an election opening onto the recording material to effect recording.

6. A recording apparatus for effecting recording comprising:

a recording head movable along a recording material;

a platen for supporting the recording material in a recording region where the recording head effects recording on the recording material;

a confining member for urging the recording material supported on said platen, said confining member being extended along a movable range of the recording head, covering the recording region and a region outside the recording region;

a carriage for moving the recording head in the recording region and the region outside the recording region, wherein said confining member comprises an elastically deformable tapered portion which is inclined away from said carriage toward an end of said confining member, wherein said carriage rides on said confining member from said tapered portion of said confining member, and is in movable contact with said confining member, and wherein said carriage comprises an elastic supporting member contactable to said confining member to elastically support said carriage, said elastic supporting member being movable toward and away from said tapered portion in the region outside the recording region.

7. An apparatus according to claim 6, wherein the recording head is an ink let recording head including an election opening, wherein ink is elected through the ejection opening onto the recording material to effect recording.

8. An apparatus according to claim 6, wherein the recording head is provided with an electrothermal transducer for producing thermal energy for ejecting ink through an ejection opening onto the recording material to effect recording.

9. An apparatus according to claim 6, wherein said recording head includes an ink jet recording head provided with an electrothermal transducer for producing thermal energy for ejecting ink.

10. An apparatus according to claim 9, wherein the thermal energy produces film boiling of the ink to eject the ink.

11. A carriage movement method for recording apparatus, the method comprising:

providing a recording head;

providing a carriage for supporting the recording head, the carriage being movable along a recording material;

providing a recording material confining member arranged to be contacted by the carriage during recording, the confining member having an elastic member; and producing elastic deformation in the elastic member upon movement of the carriage from a non-recording region to a recording region.

12. A method according to claim 11, further comprising a step of providing a platen, the platen including an escape for permitting elastic deformation of the confining member.

13. A method according to claim 11, wherein said step of providing a recording head further comprises providing an ink jet recording head having an ejection outlet, the ink Jet recording head ejecting ink through the ejection outlet onto the recording material to effect recording.

14. A method according to claim 11, wherein said step of providing a recording head further comprises providing an ink jet recording head provided with an electrothermal transducer for producing thermal energy for ejecting the ink.

15. A method according to claim 14, wherein, in said step of providing an ink let recording head, the thermal energy produces film boiling of the ink to eject the ink.

16. An apparatus provided with a carriage for reciprocating a head member carried thereon along a sheet, said apparatus comprising:

a platen for supporting a sheet at a position where the sheet can face said carriage;

a carriage supporting member extended on and along said platen across a sheet feeding path on said platen, said carriage supporting member having a surface which supports weight of said carriage and on which said carriage slides;

wherein said carriage supporting member comprises an elastically deformable tapered portion which is inclined away from said carriage toward an end of said carriage supporting member, wherein said carriage rides on said carriage supporting member from said tapered portion of said carriage supporting member, and is in movable contact with said carriage supporting member, and wherein said platen comprises an escape for said carriage supporting member adjacent to said carriage supporting member.

17. An apparatus according to claim 16, wherein said head member is a recording head for effecting recording on the sheet.

18. An apparatus according to claim 17, wherein said head member is an ink jet recording head for effecting recording by ejection of ink.

19. An apparatus according to claim 18, wherein said head member is an ink jet recording head provided with an electrothermal transducer element for ejecting ink.

20. An apparatus provided with a carriage for reciprocating a head member carried thereon along a sheet, said apparatus comprising:

a platen for supporting a sheet at a position where the sheet can face said carriage;

a carriage supporting member extended on and along said platen across a sheet feeding path on said platen, said carriage supporting member having a surface which supports weight of said carriage and on which said carriage slides;

wherein said carriage supporting member comprises a tapered portion which is inclined away from said carriage toward an end of said carriage supporting member, wherein said carriage rides on said carriage supporting member from said tapered portion of said carriage supporting member, and is in movable contact with said carriage supporting memeber, and wherein said carriage comprises an elastic supporting member contactable to said carriage supporting member to elastically support said carriage, said elastic supporting member being movable toward and away from said tapered portion.

21. an apparatus according to claim 20, wherein said head member is a recording head for effecting recording on the sheet.

22. An apparatus according to claim 21, wherein said head member is an ink jet recording head for effecting recording by ejection of ink.

23. An apparatus according to claim 22, wherein said head member is an ink jet recording head provided with an electrothermal transducer element for ejecting ink.

* * * * *

UNITED STATES PATENT AND TRADEMARK OFFICE

CERTIFICATE OF CORRECTION

PATENT NO. : 5,975,778

DATED : November 2, 1999

INVENTOR(S): SHINJI KANEMITSU

It is certified that error appears in the above-identified patent and that said Letters Patent is hereby corrected as shown below:

ON THE TITLE PAGE:

AT [56] REFERENCES CITED; FOREIGN PATENT DOCUMENTS

Insert --59090 4/1983 Japan--.

COLUMN 3

Line 25, "means." should read --means--.

COLUMN 4

Line 32, "fed," should read --fed out,--.

UNITED STATES PATENT AND TRADEMARK OFFICE

CERTIFICATE OF CORRECTION

PATENT NO. : 5,975,778

DATED : November 2, 1999

INVENTOR(S): SHINJI KANEMITSU

It is certified that error appears in the above-identified patent and that said Letters Patent is hereby corrected as shown below:

COLUMN 5

Line 30, "Signal," should read --signal,--.

COLUMN 7

Line 57, "fore" should read --fore,--.

COLUMN 8

Line 33, "elements" should read --elements.--.

UNITED STATES PATENT AND TRADEMARK OFFICE

CERTIFICATE OF CORRECTION

PATENT NO. : 5,975,778

DATED : November 2, 1999

INVENTOR(S): SHINJI KANEMITSU

It is certified that error appears in the above-identified patent and that said Letters Patent is hereby corrected as shown below:

COLUMN 10

Line 66, "election" should read --ejection--.

COLUMN 11

Line 13, "an elastically" should read --a--;

UNITED STATES PATENT AND TRADEMARK OFFICE

CERTIFICATE OF CORRECTION

PATENT NO. : 5,975,778

DATED : November 2, 1999

INVENTOR(S): SHINJI KANEMITSU

It is certified that error appears in the above-identified patent and that said Letters Patent is hereby corrected as shown below:

Line 28, "let" should read --jet--, and "election" should read --ejection--;
Line 29, "elected" should read --ejected--;
Line 58, "Jet" should read --jet--; and
Line 66, "let" should read --jet--.

COLUMN 12

Line 21, after "adjacent to" insert --said tapered portion to permit elastic deformation of--;

UNITED STATES PATENT AND TRADEMARK OFFICE

CERTIFICATE OF CORRECTION

PATENT NO. : 5,975,778

DATED : November 2, 1999

INVENTOR(S): SHINJI KANEMITSU

It is certified that error appears in the above-identified patent and that said Letters Patent is hereby corrected as shown below:

Line 51, "memeber," should read --member,--; and
Line 57, "an" should read --An--.

Signed and Sealed this

Twenty-third Day of January, 2001

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,975,778
DATED : November 2,1999
INVENTOR(S) : Shinji Kanemitsu

It is certified that error appears in the above-identified patent and that said Letters Patent is hereby corrected as shown below:

Title page,
Item [56], References Cited, FOREIGN PATENT DOCUMENTS, insert
-- 59090 4/1983 Japan --.

Column 3,
Line 25, "means." should read -- means --.

Column 4,
Line 32, "fed," should read -- fed out, --.

Column 5,
Line 30, "Signal," should read -- signal, --.

Column 7,
Line 57, "fore" should read -- fore, --.

Column 8,
Line 33, "elements" should read -- elements. --.

Column 10,
Line 66, "election" should read -- ejection --.

Column 11,
Line 13, "an elastically" should read -- a --;
Line 15, "deformable" should be deleted.
Line 28, "let" should read -- jet -- and "election" should read -- ejection --;
Line 29, "elected" should read -- ejected --;
Line 58, "Jet" should read -- jet --; and
Line 66, "let" should read -- jet --.

UNITED STATES PATENT AND TRADEMARK OFFICE

CERTIFICATE OF CORRECTION

PATENT NO. : 5,975,778
DATED : November 2,1999
INVENTOR(S) : Shinji Kanemitsu

It is certified that error appears in the above-identified patent and that said Letters Patent is hereby corrected as shown below:

Column 12,
Line 21, after "adjacent to" insert -- said tapered portion to permit elastic deformation of --;
Line 51, "memeber," should read -- member, --; and
Line 57, "an" should read -- An --.

Signed and Sealed this

Twenty-fifth Day of December, 2001

*Attest:*

*Attesting Officer*

JAMES E. ROGAN
*Director of the United States Patent and Trademark Office*